US011814974B2

(12) United States Patent
Bollapragada et al.

(10) Patent No.: US 11,814,974 B2
(45) Date of Patent: Nov. 14, 2023

(54) INTERNALLY COOLED TURBINE TIP SHROUD COMPONENT

(71) Applicant: Solar Turbines Incorporated, San Diego, CA (US)

(72) Inventors: Sudhakar Bollapragada, San Diego, CA (US); Xiaoqiang Zeng, San Diego, CA (US); Michael D. Fox, San Diego, CA (US); Branden R. Elam, Oroville, CA (US); Daniel Ryan, La Mesa, CA (US); Karen A. Thole, State College, PA (US); Thomas M. Corbett, State College, PA (US)

(73) Assignee: Solar Turbines Incorporated, San Diego, CA (US)

( * ) Notice: Subject to any disclaimer, the term of this patent is extended or adjusted under 35 U.S.C. 154(b) by 96 days.

(21) Appl. No.: 17/389,005

(22) Filed: Jul. 29, 2021

(65) Prior Publication Data

US 2023/0035029 A1 Feb. 2, 2023

(51) Int. Cl.
*F01D 25/12* (2006.01)

(52) U.S. Cl.
CPC ..... *F01D 25/12* (2013.01); *F05D 2260/20* (2013.01)

(58) Field of Classification Search
CPC . F01D 11/08; F01D 9/04; F01D 25/12; F05D 2240/11; F05D 2260/20
See application file for complete search history.

(56) References Cited

U.S. PATENT DOCUMENTS

| | | | | |
|---|---|---|---|---|
| 3,800,864 | A * | 4/1974 | Hauser | F01D 25/12 165/47 |
| 6,379,528 | B1 | 4/2002 | Lee et al. | |
| 7,306,424 | B2 | 12/2007 | Raytheon | |
| 8,596,962 | B1 * | 12/2013 | Liang | F01D 11/24 415/95 |
| 10,036,271 | B2 * | 7/2018 | Ryan | F02C 3/04 |
| 10,053,988 | B2 | 8/2018 | Itzel et al. | |
| 10,202,864 | B2 | 2/2019 | Raytheon | |
| 10,533,454 | B2 | 1/2020 | Synnott et al. | |
| 10,815,828 | B2 | 6/2020 | Widener | |
| 10,837,315 | B2 | 11/2020 | Lacy et al. | |
| 11,092,081 | B1 * | 8/2021 | Pier | F02C 7/12 |
| 11,454,137 | B1 * | 9/2022 | Chong | F01D 25/14 |
| 2006/0140753 | A1 * | 6/2006 | Romanov | F01D 25/12 415/173.1 |

(Continued)

FOREIGN PATENT DOCUMENTS

| | | | |
|---|---|---|---|
| KR | 10-2019-0083836 | A | 7/2019 |
| WO | 2020089540 | A1 | 5/2020 |
| WO | 2020239559 | A1 | 12/2020 |

*Primary Examiner* — Courtney D Heinle
*Assistant Examiner* — Andrew Thanh Bui
(74) *Attorney, Agent, or Firm* — Procopio, Cory, Hargreaves & Savitch LLP

(57) ABSTRACT

A tip shroud, comprising a plurality of tip shoes encircling a rotor assembly, in a turbine may deform due to thermal gradients experienced during operation of the turbine. Accordingly, a tip shoe is disclosed that utilizes an internal cooling cavity to supply coolant throughout the interior of the tip shoe, as well as to the slash faces of the tip shoe. In addition, features are described that increase the surface area exposed to the coolant, while remaining suitable for additive manufacturing.

19 Claims, 12 Drawing Sheets

(56) References Cited

U.S. PATENT DOCUMENTS

| | | | | |
|---|---|---|---|---|
| 2007/0031240 | A1* | 2/2007 | Nichols | F01D 11/08 415/115 |
| 2008/0079523 | A1* | 4/2008 | Tholen | B22C 9/10 336/60 |
| 2013/0108416 | A1* | 5/2013 | Piggush | F01D 11/24 415/173.1 |
| 2013/0323032 | A1* | 12/2013 | Lutjen | F04D 29/164 415/173.1 |
| 2017/0226885 | A1* | 8/2017 | Clum | F01D 9/02 |
| 2018/0223681 | A1 | 8/2018 | Gallier et al. | |
| 2019/0120081 | A1 | 4/2019 | Doosan | |
| 2020/0025026 | A1 | 1/2020 | Packer et al. | |
| 2022/0275734 | A1* | 9/2022 | Sakamoto | F01D 9/04 |

* cited by examiner

INTERNALLY COOLED TURBINE TIP SHROUD COMPONENT

TECHNICAL FIELD

The embodiments described herein are generally directed to a tip shroud of a turbine, and, more particularly, to features for cooling a turbine tip shroud that can be manufactured using additive manufacturing.

BACKGROUND

Some turbines comprise a tip shroud that forms a ring or annulus around the rotor assembly. The tip shroud may comprise a plurality of curved segments, referred to as "tip shoes."

Due to thermal gradients, a tip shoe may deform over time, relative to its original, curved shape. This deformation of the tip shoe geometry alters the intended outer flow path of the turbine working fluid and causes non-uniform clearances in the rotor assembly.

To reduce such deformations due to thermal gradients, the tip shoes may be cooled. Typically, tip shoes are cooled via convective cooling, impingement cooling, or film cooling. Each of these types of cooling rely on a cooling flow around and along the outer surfaces of the tip shoe. However, such types of cooling are insufficient to cool the entire mass of the tip shoe.

U.S. Pat. No. 10,202,864 discloses a blade outer air seal that has cooling channels within the blade outer air seal. Such internal cooling may improve cooling of the tip shoe. However, the channels in the blade outer air seal are insufficient to cool the entire mass of the blade outer air seal.

The present disclosure is directed toward overcoming one or more of the problems discovered by the inventors.

SUMMARY

In an embodiment, a tip shoe is disclosed that comprises: a top surface; an internal cooling cavity; two slash faces on opposing ends of the tip shoe; a plurality of inlets through the top surface and in fluid communication with the internal cooling cavity; and a plurality of outlets through each of the two slash faces and in fluid communication with the internal cooling cavity.

In an embodiment, an annular tip shroud is disclosed that comprises a plurality of tip shoes, wherein each of the plurality of tip shoes includes: a top surface; an internal cooling cavity; two slash faces on opposing ends of the tip shoe; a plurality of inlets through the top surface and connected to the internal cooling cavity; and a plurality of outlets through each of the two slash faces and connected to the internal cooling cavity.

In an embodiment, a turbine is disclosed that comprises: one or more rotor assemblies; and a tip shroud encircling each of the one or more rotor assemblies, wherein each tip shroud includes a plurality of tip shoes, and wherein each of the plurality of tip shoes includes a top surface, an internal cooling cavity, two slash faces on opposing ends of the tip shoe, a plurality of inlets through the top surface and connected to the internal cooling cavity, and a plurality of outlets through each of the two slash faces and connected to the internal cooling cavity.

BRIEF DESCRIPTION OF THE DRAWINGS

The details of embodiments of the present disclosure, both as to their structure and operation, may be gleaned in part by study of the accompanying drawings, in which like reference numerals refer to like parts, and in which.

DETAILED DESCRIPTION

Figure 1:
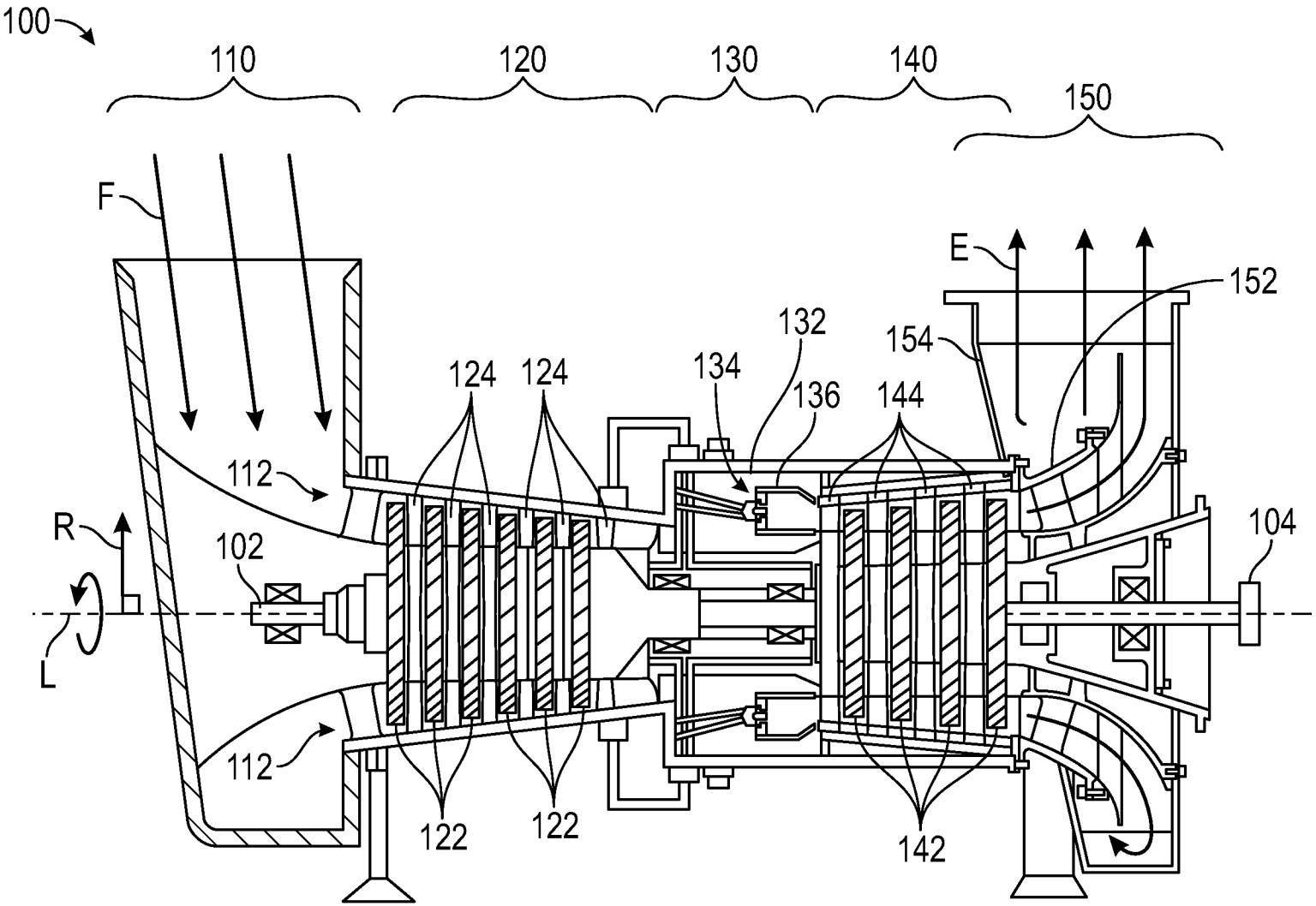
FIG. 1 illustrates a schematic diagram of a gas turbine engine, according to an embodiment.

The detailed description set forth below, in connection with the accompanying drawings, is intended as a description of various embodiments, and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

For clarity and ease of explanation, some surfaces and details may be omitted in the present description and figures. In addition, references herein to "upstream" and "downstream" or "forward" and "aft" are relative to the flow direction of the primary gas (e.g., air) used in the combustion process, unless specified otherwise. It should be understood that "upstream," "forward," and "leading" refer to a position that is closer to the source of the primary gas or a direction towards the source of the primary gas, and "downstream," "aft," and "trailing" refer to a position that is farther from the source of the primary gas or a direction that is away from the source of the primary gas. Thus, a trailing edge or end of a component (e.g., a turbine blade) is downstream from a leading edge or end of the same component. Also, it should be understood that, as used herein, the terms "side," "top," "bottom," "front," "rear," "above," "below," and the like are used for convenience of understanding to convey the relative positions of various components with respect to each other, and do not imply any specific orientation of those components in absolute terms (e.g., with respect to the external environment or the ground). In addition, it should be understood that the various components illustrated herein are not necessarily drawn to scale. In other words, the features disclosed in various embodiments may be implemented using different relative dimensions within and between components than those illustrated in the drawings.

FIG. 1 illustrates a schematic diagram of a gas turbine engine 100, according to an embodiment. Gas turbine engine 100 comprises a shaft 102 with a central longitudinal axis L. A number of other components of gas turbine engine 100 are concentric with longitudinal axis L and may be annular to longitudinal axis L. A radial axis may refer to any axis or direction that radiates outward from longitudinal axis L at a substantially orthogonal angle to longitudinal axis L, such as radial axis R in FIG. 1. Thus, the term "radially outward" should be understood to mean farther from or away from longitudinal axis L, whereas the term "radially inward" should be understood to mean closer or towards longitudinal axis L. As used herein, the term "axial" will refer to any axis or direction that is substantially parallel to longitudinal axis L.

In an embodiment, gas turbine engine 100 comprises, from an upstream end to a downstream end, an inlet 110, a compressor 120, a combustor 130, a turbine 140, and an exhaust outlet 150. In addition, the downstream end of gas turbine engine 100 may comprise a power output coupling 104. One or more, including potentially all, of these components of gas turbine engine 100 may be made from stainless steel and/or durable, high-temperature materials known as "superalloys." A superalloy is an alloy that exhibits excellent mechanical strength and creep resistance at high temperatures, good surface stability, and corrosion and oxidation resistance. Examples of superalloys include, without limitation, Hastelloy, Inconel, Waspaloy, Rene alloys, Haynes alloys, Incoloy, MP98T, TMS alloys, and CMSX single crystal alloys.

Inlet 110 may funnel a working fluid F (e.g., the primary gas, such as air) into an annular flow path 112 around longitudinal axis L. Working fluid F flows through inlet 110 into compressor 120. While working fluid F is illustrated as flowing into inlet 110 from a particular direction and at an angle that is substantially orthogonal to longitudinal axis L, it should be understood that inlet 110 may be configured to receive working fluid F from any direction and at any angle that is appropriate for the particular application of gas turbine engine 100. While working fluid F will primarily be described herein as air, it should be understood that working fluid F could comprise other fluids, including other gases.

Compressor 120 may comprise a series of compressor rotor assemblies 122 and stator assemblies 124. Each compressor rotor assembly 122 may comprise a rotor disk that is circumferentially populated with a plurality of rotor blades. The rotor blades in a rotor disk are separated, along the axial axis, from the rotor blades in an adjacent disk by a stator assembly 124. Compressor 120 compresses working fluid F through a series of stages corresponding to each compressor rotor assembly 122. The compressed working fluid F then flows from compressor 120 into combustor 130.

Combustor 130 may comprise a combustor case 132 that houses one or more, and generally a plurality of, fuel injectors 134. In an embodiment with a plurality of fuel injectors 134, fuel injectors 134 may be arranged circumferentially around longitudinal axis L within combustor case 132 at equidistant intervals. Combustor case 132 diffuses working fluid F, and fuel injector(s) 134 inject fuel into working fluid F. This injected fuel is ignited to produce a combustion reaction in one or more combustion chambers 136. The combusting fuel-gas mixture drives turbine 140.

Turbine 140 may comprise one or more turbine rotor assemblies 142 and stator assemblies 144 (e.g., nozzles). Each turbine rotor assembly 142 may correspond to one of a plurality or series of stages. Turbine 140 extracts energy from the combusting fuel-gas mixture as it passes through each stage. The energy extracted by turbine 140 may be transferred (e.g., to an external system) via power output coupling 104.

The exhaust E from turbine 140 may flow into exhaust outlet 150. Exhaust outlet 150 may comprise an exhaust diffuser 152, which diffuses exhaust E, and an exhaust collector 154 which collects, redirects, and outputs exhaust E. It should be understood that exhaust E, output by exhaust collector 154, may be further processed, for example, to reduce harmful emissions, recover heat, and/or the like. In addition, while exhaust E is illustrated as flowing out of exhaust outlet 150 in a specific direction and at an angle that is substantially orthogonal to longitudinal axis L, it should be understood that exhaust outlet 150 may be configured to output exhaust E towards any direction and at any angle that is appropriate for the particular application of gas turbine engine 100.

Figure 2:
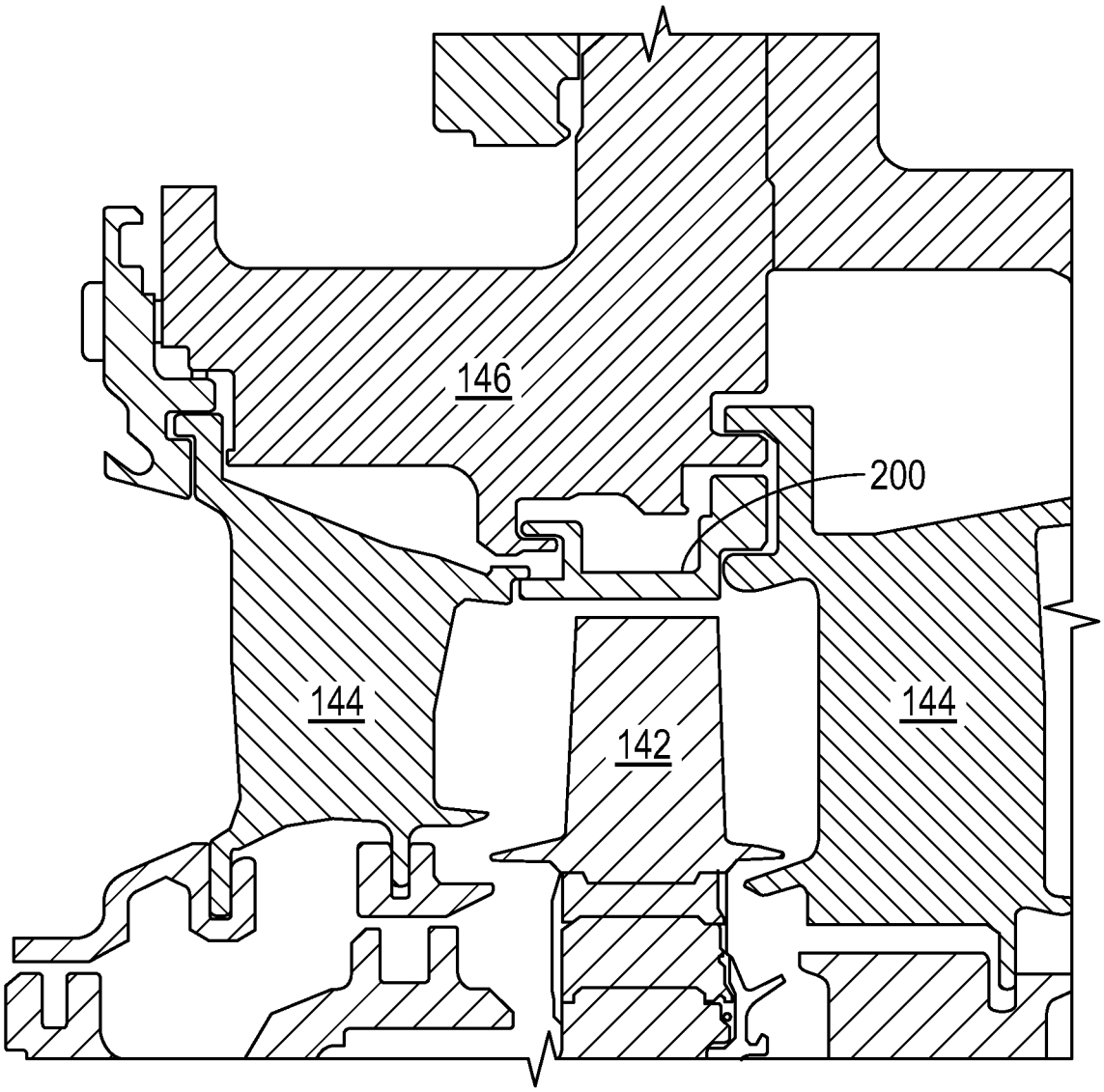
FIG. 2 illustrates a portion of a cross-sectional view of a turbine, according to an embodiment.

FIG. 2 illustrates a portion of a cross-sectional view of turbine 140, cut along a plane containing longitudinal axis L and a radial axis R, according to an embodiment. In particular, a portion of a turbine rotor assembly 142 is illustrated between two turbine stator assemblies 144. Turbine 140 also comprises a support ring 146 that supports turbine stator assemblies 144 and tip shroud 200. It should be understood that each of support ring 146 and tip shroud 200 are annular around rotor assembly 142.

In an embodiment, tip shroud 200 is formed of a plurality of segments, referred to herein as "tip shoes." For example, in a particular implementation, tip shroud 200 may be formed of twenty-four tip shoes. However, it should be understood that tip shroud 200 may be composed of any number of tip shoes. Each tip shoe is curved according to a segment of a circle, such that, collectively, the tip shoes form a circular tip shroud 200 with a diameter that fully encircles rotor assembly 142.

Figure 3:
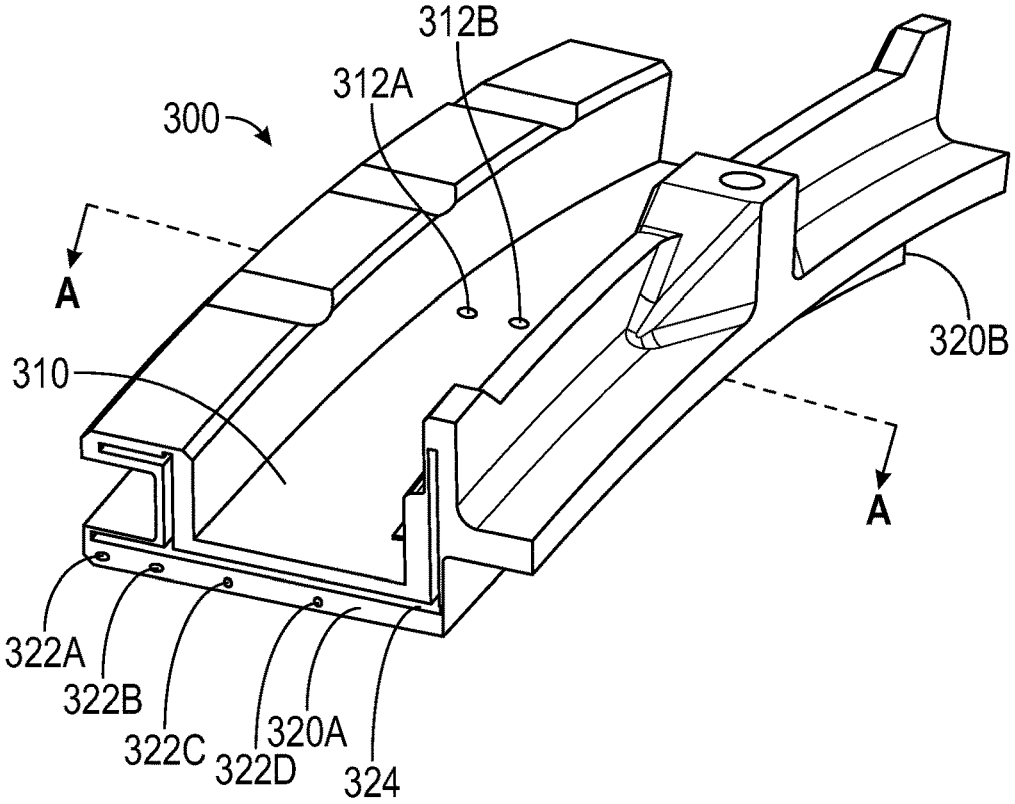
FIG. 3 illustrates a perspective view of a tip shoe, according to an embodiment.

FIG. 3 illustrates a perspective view of a single tip shoe 300 in tip shroud 200, according to an embodiment. Of relevance to the described embodiments, tip shoe 300 comprises a curved top surface 310 and two side surfaces or slash faces 320A and 320B. When installed in tip shroud 200 in turbine 140, top surface 310 faces radially outward, and each point in top surface 310 is substantially the same radius from longitudinal axis L. It should be understood that the bottom surface (not shown) of tip shoe 300 faces radially inward and forms a radially outer surface of the flow path of working fluid F through turbine 140. It should also be understood that each slash face 320 of a tip shoe 300 will abut the slash face 320 of an adjacent tip shoe 300. As used herein, the term "abut" does not require adjacent slash faces 320 to physically contact each other. Rather, a narrow gap may be present between abutting slash faces 320.

Top surface 310 comprises one or a plurality of inlets 312, which may each comprise a channel, hole, plenum, or the like. In the illustrated embodiment, top surface 310 comprises four inlets 312, but only two inlets 312A and 312B are visible in FIG. 3. However, it should be understood that top surface 310 may consist of a different number of inlets 312, including one inlet 312, two inlets 312, three inlets 312, or five or more inlets 312.

Inlet(s) 312 may be formed in or near the center of top surface 310. Alternatively, inlet(s) 312 may be formed in a different region of top surface 310. In an embodiment which comprises a plurality of inlets 312, inlets 312 may be aligned with each other along an axial axis A, parallel to longitudinal axis L, that bisects top surface 310. However, it should be understood that a plurality of inlets 312 may be aligned along a different axis or formed according to a different pattern. In an embodiment, the positions of inlets 312 through top surface 310 are symmetric across the bisecting axial axis A, such that coolant is distributed uniformly from inlets 312 towards both slash faces 320A and 320B.

Each inlet 312 may extend along a radial axis R to provide fluid communication from a region radially outward from tip shoe 300 to an internal cooling cavity within tip shoe 300. The internal cooling cavity may comprise a plurality of channels and/or chambers that distribute coolant throughout tip shoe 300. The coolant may comprise cooling air from compressor 120 that bypasses combustor 130. In an embodiment, the internal cooling cavity is symmetric across the bisecting axial axis A of tip shoe 300, such that coolant is distributed uniformly from inlets 312 towards both slash faces 320A and 320B.

Each slash face 320 may comprise a plurality of outlets 322, which may each comprise a channel, hole, plenum, or the like. The coolant that enters the internal cooling cavity via inlet(s) 312 exits the internal cooling cavity via outlets 322 in both slash faces 320A and 320B of tip shoe 300. While each tip shoe 300 will abut an adjacent tip shoe 300 at both slash faces 320A and 320B, a narrow gap may exist between each pair of adjacent tip shoes 300, such that coolant exiting outlets 322 may escape through the gap.

Figure 4:
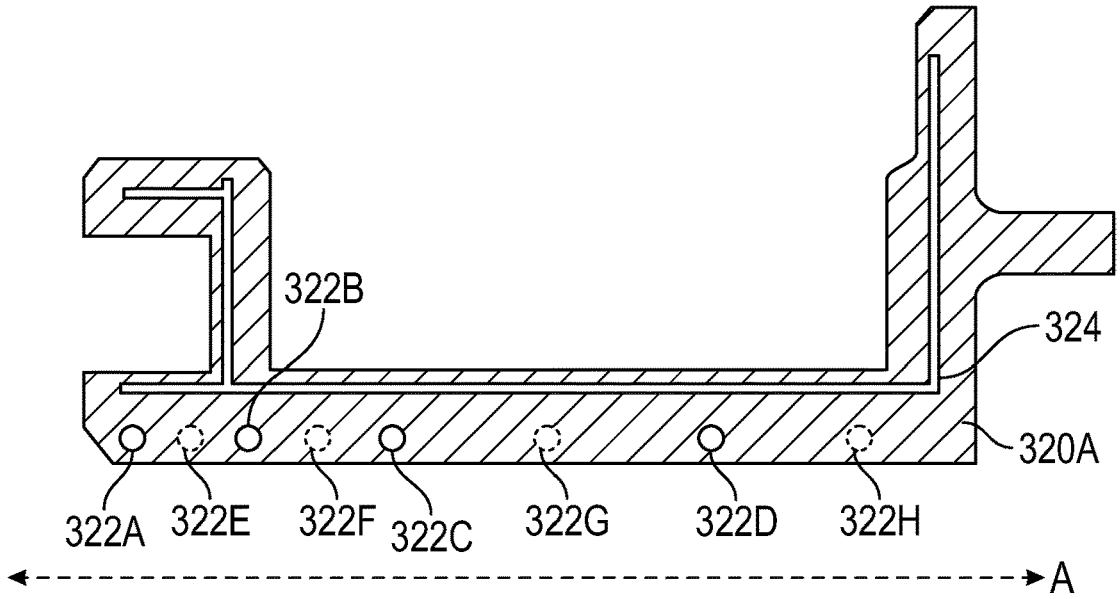
FIG. 4 illustrates relative positions of outlets of the slash faces of a tip shoe, according to an embodiment.

In an embodiment, the outlets 322 of slash face 320A are staggered with respect to the outlets 322 of slash face 320B. FIG. 4 illustrates outlets 322E, 322F, 322G, and 322H of slash face 320B superimposed on slash face 320A to illustrate the relative positions, according to an embodiment. As illustrated, along axial axis A, outlet 322E of slash face 320B is positioned between outlets 322A and 322B of slash face 320A, outlet 322F of slash face 320B is positioned between outlets 322B and 322C of slash face 320A, outlet 322G of slash face 320B is positioned between outlets 322C and 322D of slash face 320A, and outlet 322H of slash face 320B is positioned downstream of outlet 322D of slash face 320A.

It should be understood that, when tip shroud 200 is assembled, the slash face 320A of each tip shoe 300 will abut the slash face 320B of a first adjacent tip shoe 300 (e.g., with a narrow gap in between), while the slash face 320B of the tip shoe 300 will abut the slash face 320A of a second adjacent tip shoe 300 (e.g., with a narrow gap in between). Since outlets 322 of the opposing slash faces 320A and 320B are staggered, the coolant is provided by outlets 322 to staggered positions along the interface of abutting slash faces 320. Consequently, more distributed cooling is provided across the interface of abutting slash faces 320A and 320B, than in a case in which outlets 322 are not staggered. Notably, during operation, the flow of coolant exiting from outlets 322 in slash face 320A of each tip shoe 300 will impinge on the slash face 320B of the adjacent tip shoe 300, and the flow of coolant exiting from outlets 322 in slash face 320B of each tip shoe 300 will impinge on the slash face 320A of the other adjacent tip shoe 300.

As illustrated, outlets 322 may be spaced more closely on the upstream side of each slash face 320 than on the downstream side of each slash face 320. In other words, along axial axis A, the spacing between adjacent outlets 322 may increase in a direction from the upstream side to the downstream side of each slash face 320, such that there is more spacing between downstream outlets 322 than upstream outlets 322. For example, the spacing between outlets 322C and 322D is greater than the spacing between outlets 322A and 322B and the spacing between outlets 322B and 322C, and the spacing between outlets 322B and 322C is greater than the spacing between outlets 322A and 322B. Thus, greater cooling is directed towards the upstream side of each slash face 320, which will generally be subjected to higher temperatures during operation of turbine 140, than the downstream side of each slash face 320.

Each slash face 320 may also comprise a system or set of one or more seal slots 324, which may be used to join adjacent tip shoes 300. Each seal slot 324 may comprise a recess in slash face 320 that extends laterally inward. In particular, one end of a connector may be inserted into a seal slot 324 of slash face 320A of tip shoe 300, and the other end of the connector may be inserted into a corresponding seal slot 324 of slash face 320B of an adjacent tip shoe 300. For example, the connector may comprise one or a plurality of pieces (e.g., four pieces) of thin sheet metal or "seal strips" that are each configured in shape and dimension to fit within seal slot 324. The connector joins adjacent tip shoes 300, while enabling the adjacent tip shoes 300 to grow and slide independently from each other.

Figure 5:
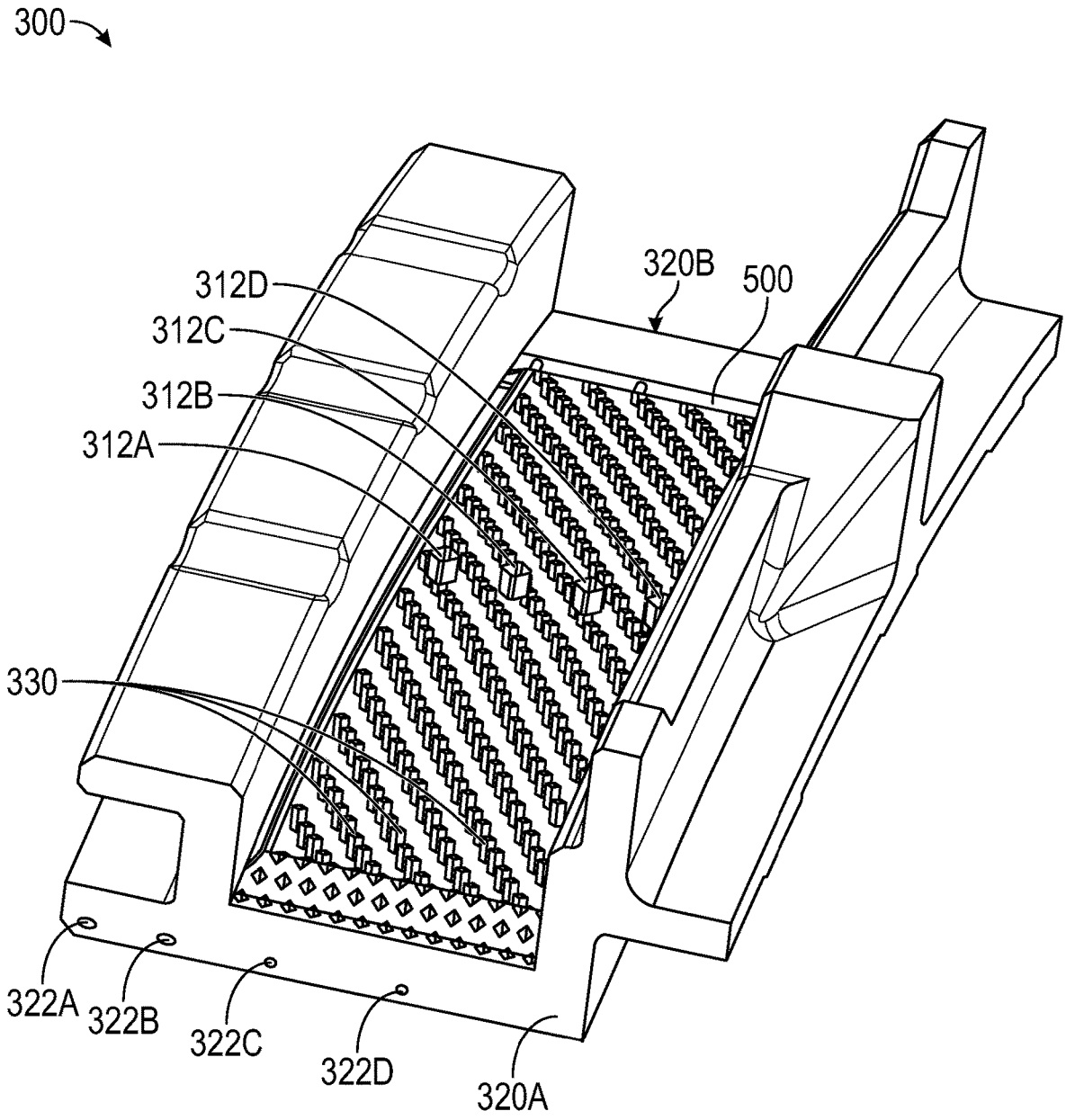
FIG. 5 illustrates an internal cooling cavity within a tip shoe, according to an embodiment.

FIG. 5 illustrates an internal cooling cavity 500, according to an embodiment. For the purpose of illustration, a top portion of tip shoe 300, including top surface 310, has been hidden to reveal internal cooling cavity 500 within tip shoe 300. In the illustrated embodiment, internal cooling cavity 500 is defined by a plurality of pins 330 that extend along radial axes through internal cooling cavity 500 in a grid pattern. Internal cooling cavity 500 comprises the space between and around pins 330. Notably, the use of pins 330 increases the surface area of tip shoe 300 that is contacted by the coolant within internal cooling cavity 500, relative to a cavity without pins. Thus, the illustrated embodiment of internal cooling cavity 500 may provide more effective and efficient cooling to tip shoe 300. In addition, pins 330 may provide a venue for heat conduction between top surface 310 and the bottom surface of tip shoe 300.

In an embodiment, pins 330 are rectangular (e.g., square) in cross-section in a cut plane that is orthogonal to a radial axis R. The rectangular cross-section may facilitate the manufacture of pins 330 using additive manufacturing (AM) or three-dimensional printing. Similarly, inlets 312 may be rectangular (e.g., square) in cross-section in a cut plane that is orthogonal to a radial axis R. The rectangular cross-section may facilitate the manufacture of inlets 312 using additive manufacturing. On the other hand, outlets 322 may be elliptical (e.g., circular) in cross-section in a cut plane that contains longitudinal axis L and a radial axis R. However, it should be understood that pins 330, inlets 312, and/or outlets 322 may comprise other cross-sectional shapes than those described and illustrated herein.

During operation of turbine 140, inlets 312 provide coolant through the center of top surface 310 into internal cooling cavity 500. The coolant flows through and around pins 330 in internal cooling cavity 500, towards both slash faces 320A and 320B, before exiting internal cooling cavity 500 via outlets 322 on both slash faces 320A and 320B. Thus, internal cooling cavity 500 acts as a heat exchanger to cool tip shoe 300, including slash faces 320, which otherwise tend to get extremely hot during operation of turbine 140.

Figure 6:
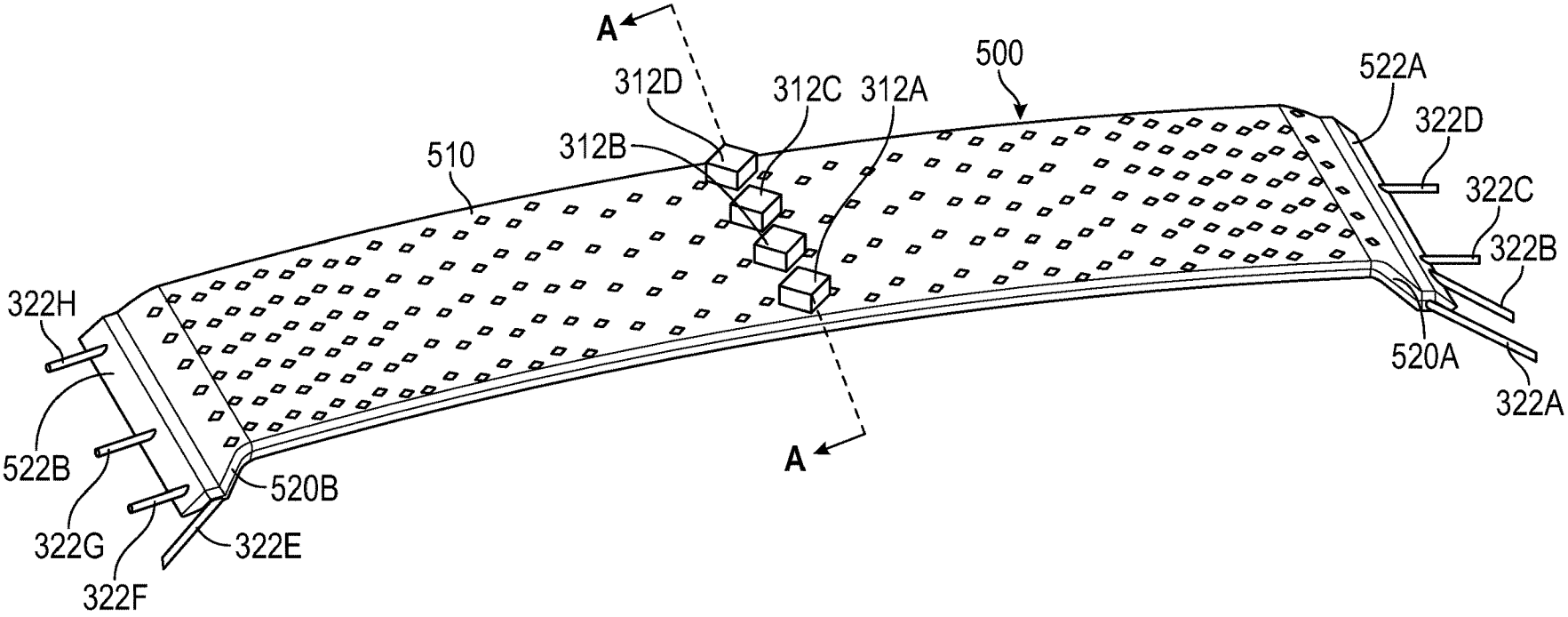
FIG. 6 illustrates an example shape of an internal cooling cavity within a tip shoe, according to an embodiment.

FIG. 6 illustrates an example shape of internal cooling cavity 500, according to an embodiment. It should be understood that FIG. 6 illustrates the space forming internal cooling cavity 500, with all physical structure of tip shoe 300, including pins 330, hidden. In an embodiment, internal cooling cavity 500 is symmetric across axial axis A, parallel to longitudinal axis L, that bisects the internal cooling cavity, except that outlets 322 may be staggered as described elsewhere herein.

One or more of outlets 322 may be angled between internal cooling cavity 500 and slash faces 320, while one or more other outlets 322 may be orthogonal to longitudinal axis L, such that they are neither angled upstream nor downstream. In an embodiment, one or more outlets 322 that are more upstream from other ones of outlets 322 are angled upstream from internal cooling cavity 500 to slash face 320, such that these outlets 322 can supply coolant near the upstream end of tip shoe 300. For example, in the illustrated embodiment, outlets 322A and 322B are angled upstream from internal cooling cavity 500 to slash face 320A, and outlet 322E is angled upstream from internal cooling cavity 500 to slash face 320B. Outlets 322C, 322D, 322F, 322G, and 322H are orthogonal to longitudinal axis L, and therefore, are not angled in the upstream or downstream direction. In an alternative embodiment, one or more outlets 322 may be angled downstream in addition to or instead of one or more outlets 322 being angled upstream. As illustrated, outlets 322 may all lie in a plane that is parallel to the radially inward-most surface of seal slot 324, or alternatively, one or more outlets 322 may be angled with respect to a plane that is parallel to the radially inward-most surface of seal slot 324.

As illustrated, a central portion 510 of internal cooling cavity 500 is generally curved to follow the shape of top surface 310. However, end portions 520 of internal cooling cavity, near slash faces 320, may curve radially inward and then laterally outward into a plenum space 522 before connecting with outlets 322, which may be positioned more radially inward than central portion 510 of internal cooling cavity 500. For example, end portion 520A may curve radially inward and then laterally outward into a plenum space 522A to connect with outlets 322A, 322B, 322C, and 322D, and opposite end portion 520B may curve radially inward and then laterally outward into a plenum space 522B to connect with outlets 322E, 322F, 322G, and 322H. As used herein, it should be understood that the term "curve radially inward" does not require the resulting flow path to transition to a fully radial direction, but is only intended to convey that the resulting flow path curves in a direction that has an inwardly radial component (e.g., in addition to a lateral component).

As illustrated in FIG. 6, the density of pins 330, represented by the holes extending radially through internal cooling cavity 500, may be non-uniform across internal cooling cavity 500. For example, the density of pins 330 may gradually increase along the flow path from inlets 312 (e.g., in the center of internal cooling cavity 500) towards outlets 333 (e.g., at the ends of internal cooling cavity 500), such that there is a greater density of pins 330 near outlets 322 than near inlets 312. The density may increase along the flow path from inlets 312 towards outlets 322 as a function of the thermal gradient that would otherwise be experienced by tip shoe 300, to maintain substantially uniform cooling across the entirety of internal cooling cavity 500 (i.e., to minimize the thermal gradient experienced by tip shoe 300). Specifically, coolant traveling from inlets 312 at the center of internal cooling cavity 500 will warm as it flows towards outlets 322. To compensate for the warming coolant, the surface area that is contacted by the coolant is gradually increased (i.e., by gradually increasing the density of pins 330) from inlets 312 towards outlets 322. The density of pins 330 may be increased by decreasing the spacing between pins 330, increasing the number of pins 330, altering the size or shape of pins 330, and/or the like.

Figure 7:
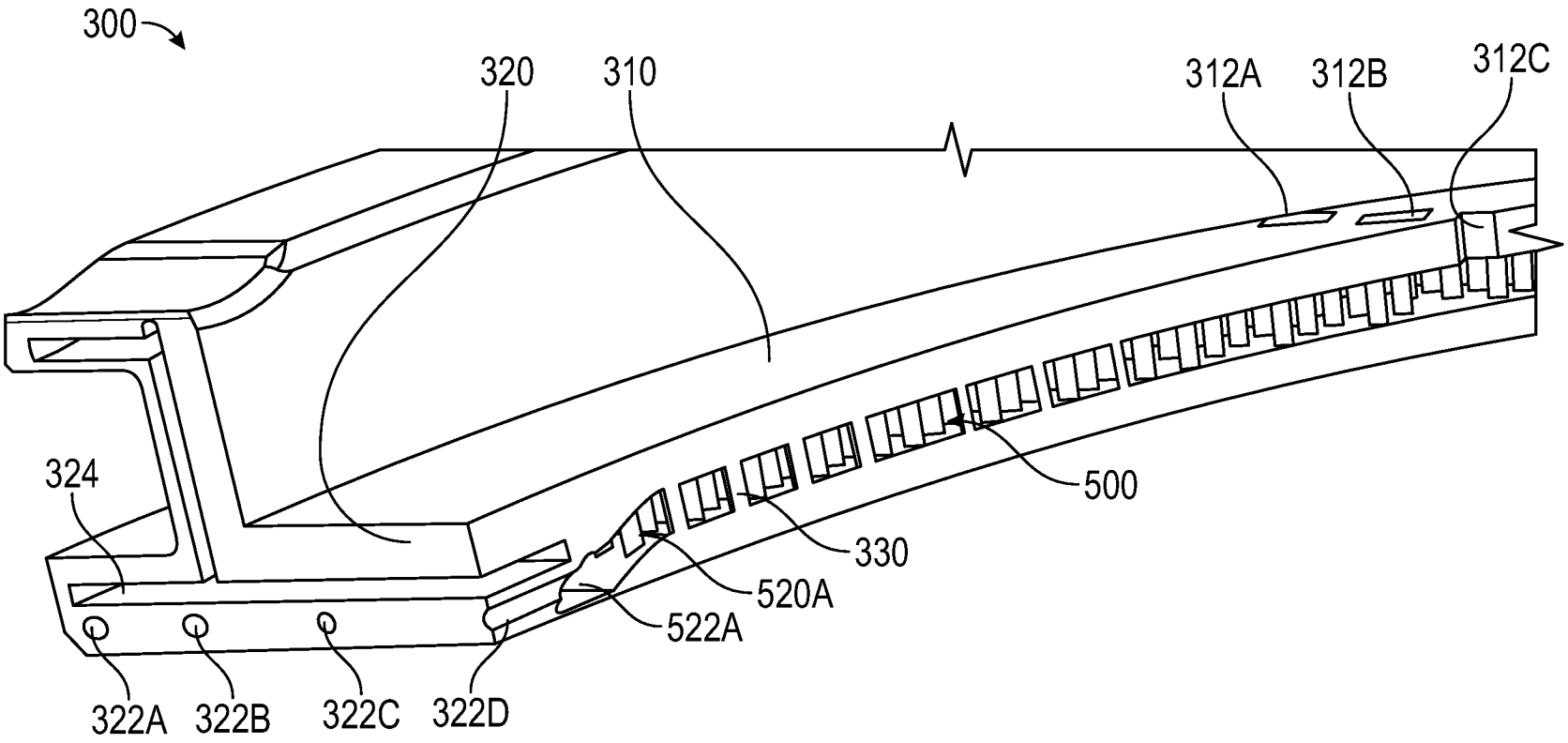
FIG. 7 illustrates a perspective cross-sectional view of a portion of a tip shoe, according to an embodiment.

FIG. 7 illustrates a perspective cross-sectional view of a portion of tip shoe 300, cut along a plane that is perpendicular to longitudinal axis L, according to an embodiment. Notably, end portion 520A of internal cooling cavity 500 curves radially inward into a plenum space 522A that is radially inward from seal slot 324. Thus, outlets 322 extend laterally outward at a position that is radially inward from seal slot 324 and nearer to the edge of the bottom surface of tip shoe 300, which partially defines the flow path for working fluid F. Accordingly, outlets 322 can distribute coolant to the edge of slash face 320 that generally experiences the highest temperatures during operation. The coolant, exiting outlets 322, may also cool the seal strips in seal slots 324 connecting adjacent tip shoes 300.

Figure 8:
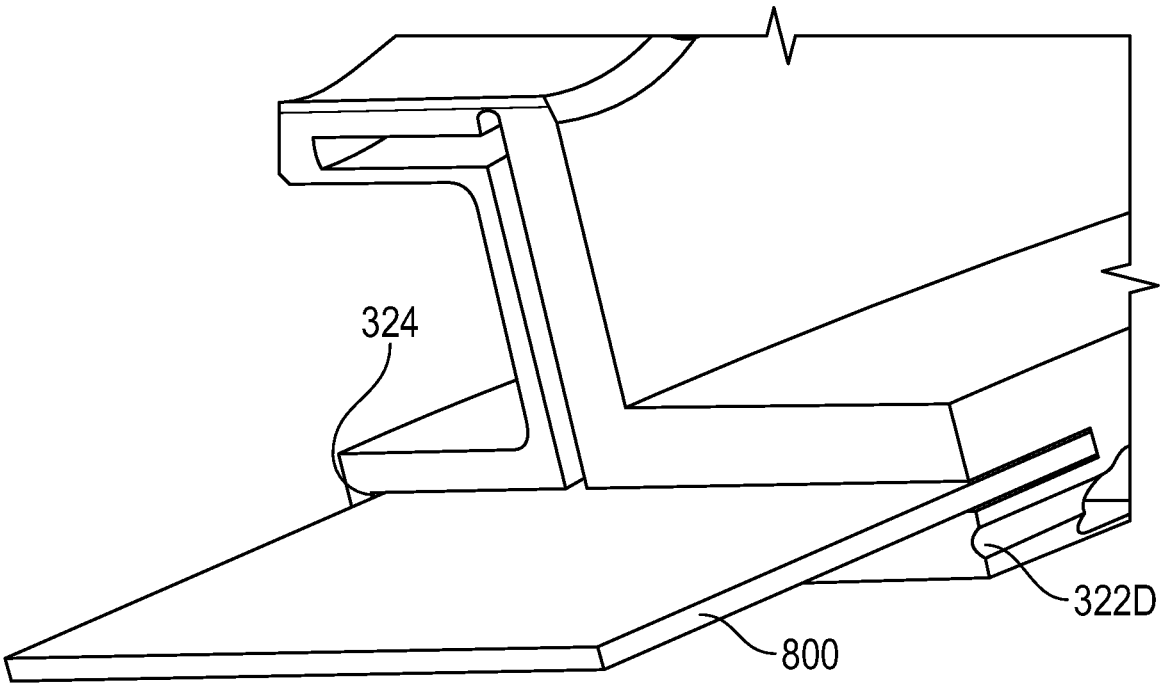
FIG. 8 illustrates a perspective cross-sectional view of a portion of a tip shoe, with a seal strip inserted, according to an embodiment.

FIG. 8 illustrates a perspective cross-sectional view of a portion of tip shoe 300, cut along a plane that is perpendicular to longitudinal axis L, with a seal strip 800 inserted in the radially inward-most recess of seal slot 324, according to an embodiment. Similar seal strips may be inserted in the other recesses of seal slot 324. Notably, as coolant exits outlets 322 (e.g., 322D), the coolant will cool seal strip 800. Thus, the coolant exiting outlets 322 cools both slash faces 320 and seal strips 800.

Figure 9:
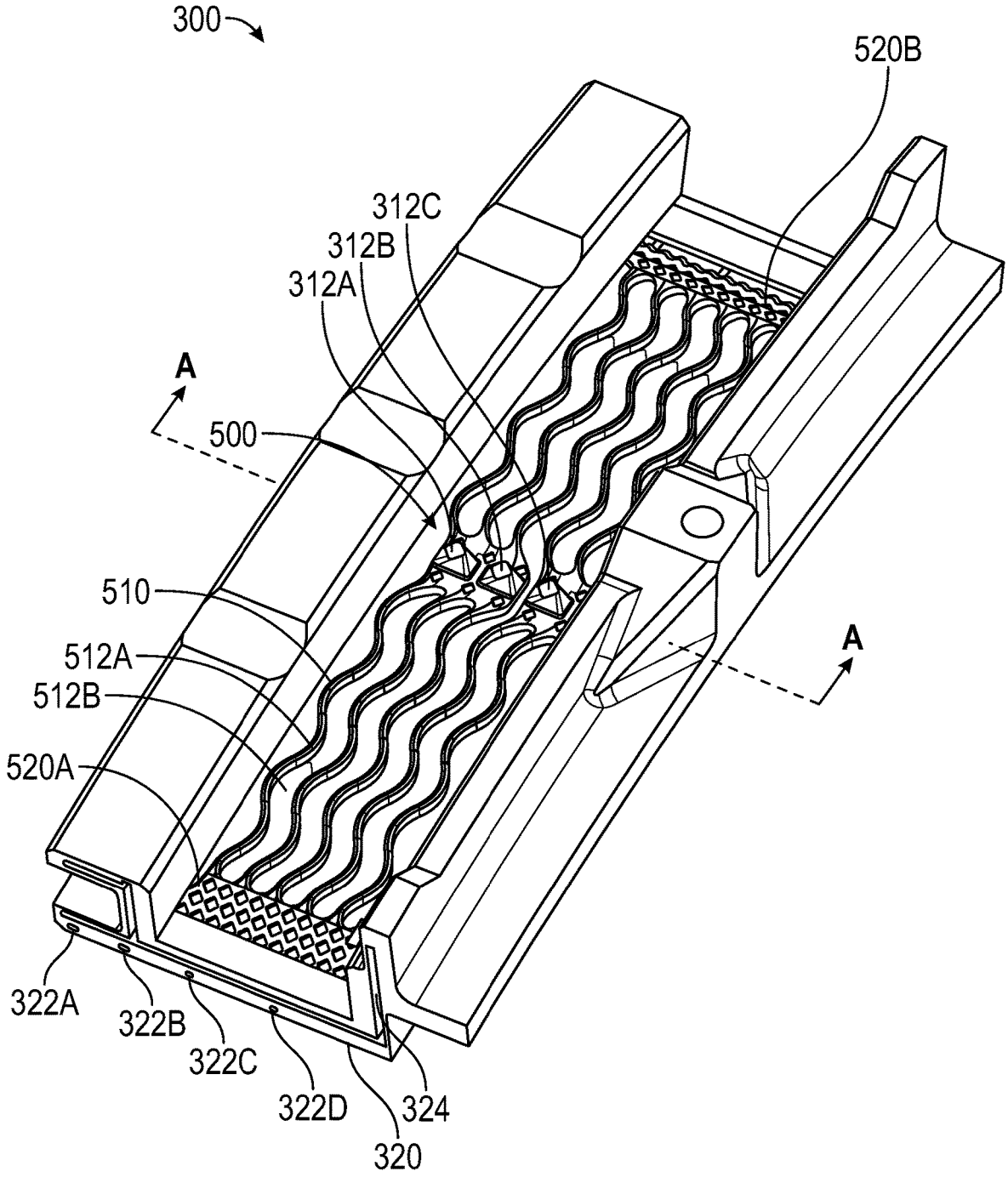
FIG. 9 illustrates an internal cooling cavity within a tip shoe, according to an embodiment.

FIG. 9 illustrates an internal cooling cavity 500, according to an alternative embodiment. For the purpose of illustration, a top portion of tip shoe 300, including top surface 310, has been hidden to reveal internal cooling cavity 500 within tip shoe 300. It should be understood that the space of internal cooling cavity 500 is illustrated in FIG. 8, with surrounding physical structures removed. Like the embodiment illustrated in FIG. 5, internal cooling cavity 500 may be symmetric along an axial axis A that bisects internal cooling cavity, and may comprise the same or similar set of inlets 312 that feed coolant to a central portion 510, which in turn supplies coolant to end portions 520 that curve radially inward into plenum spaces 522 that supply a same or similar set of outlets 322 through slash faces 320.

However, unlike the embodiment illustrated in FIG. 5, the central portion 510 of internal cooling cavity 500 in the embodiment illustrated in FIG. 9 comprises a plurality of congruent wavy channels 512 that each extend from a radially inward end of an inlet 312. Each inlet 312 may supply coolant to one or a plurality of wavy channels 512. The plurality of wavy channels 512 may extend parallel to each other and laterally outward from inlets 312. The plurality of wavy channels 312 may be, but are not required to be, spaced at equidistant intervals along axial axis A.

Figure 10:
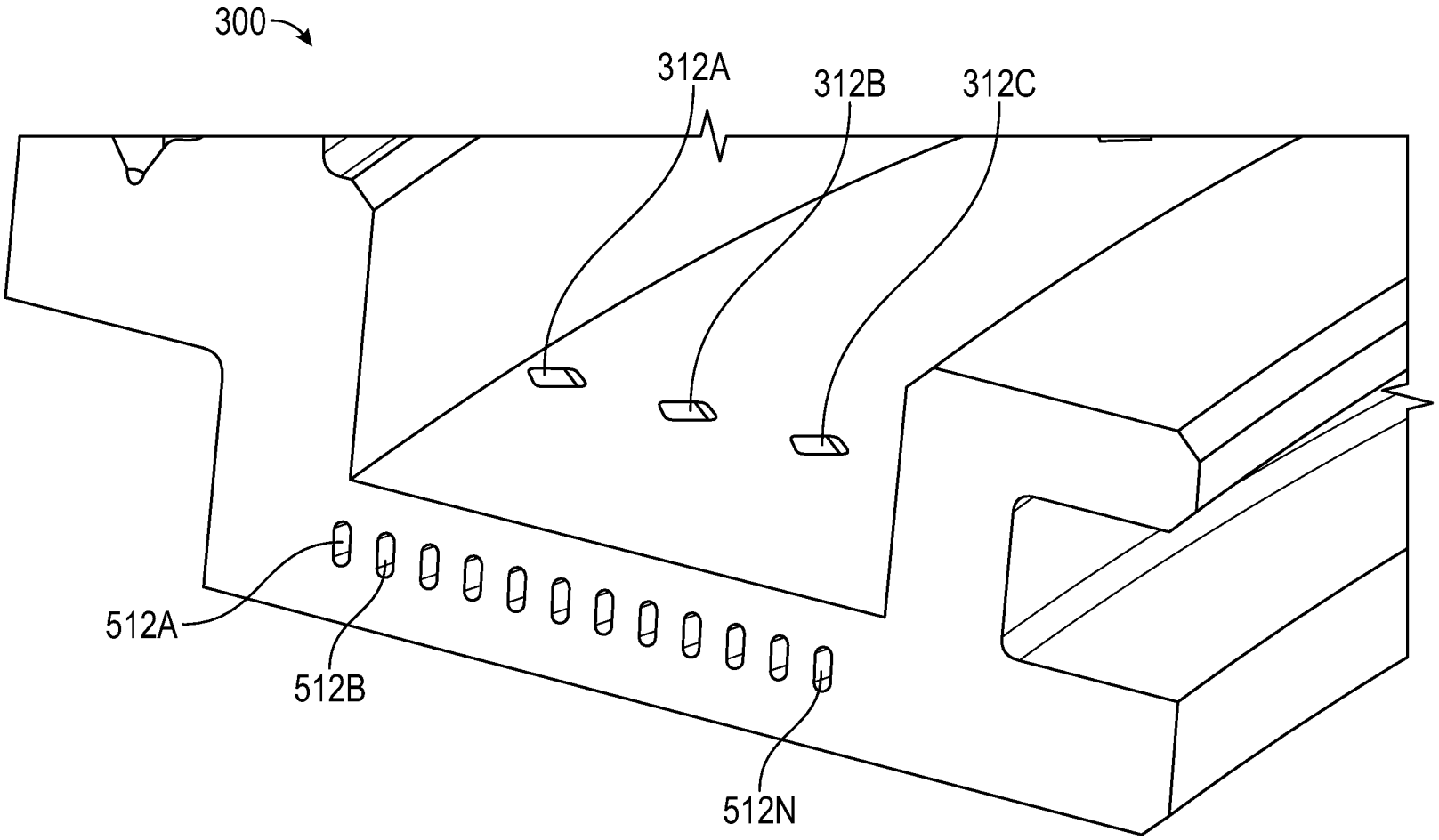
FIG. 10 illustrates a cross-sectional view of a portion of a tip shoe, according to an embodiment.

It should be understood that, in reality, the spaces between the plurality of wavy channels 512 are filled with material (e.g., the same material as top surface 310). This is illustrated in FIG. 10, which is a cross-sectional view of tip shoe 300, cut along an plane containing longitudinal axis L and a radial axis R, according to an embodiment.

End portions 520 of internal cooling cavity 500 may be defined by a plurality of pins (e.g., similar or identical to pins 330) that extend along radial axes through internal cooling cavity 500, in a grid pattern. End portions 520 comprise the spaces between and around the pins. The use of the pins may provide more surface area and provide a venue for heat conduction between top surface 310 and the bottom surface of tip shoe 300, to increase cooling at the ends of tip shoe 300, which can be prone to higher temperatures and exposed to warmer coolant than the center of tip shoe 300.

Although not specifically illustrated, the density of wavy channels 512 may be non-uniform across internal cooling cavity 500. For example, the density of wavy channels 512 may gradually increase along the flow path from inlets 312 (e.g., in the center of internal cooling cavity 500) towards outlets 322 (e.g., at the ends of internal cooling cavity 500), such that there is a greater density of wavy channels 512 near outlets 322 than near inlets 312. The density may increase along the flow path from inlets 312 towards outlets 322 as a function of the thermal gradient that would otherwise be experienced by tip shoe 300, to maintain substantially uniform cooling across the entirety of internal cooling cavity 500 (i.e., to minimize the thermal gradient experienced by tip shoe 300). Specifically, coolant traveling from inlets 312 at the center of internal cooling cavity 500 will warm as it flows towards outlets 322. To compensate for the warming coolant, the surface area that is contacted by the coolant is gradually increased (i.e., by gradually increasing the density of wavy channels 512) from inlets 312 towards outlets 322. The density of wavy channels 512 may be increased by decreasing the wavelength of wavy channels 512, increasing the amplitude of wavy channels 512, decreasing the spacing between wavy channels 512, increasing the number of wavy channels 512 (e.g., by branching a single wavy channel 512 into two or more wavy channels 512), and/or the like. In other words, the shapes of wavy channels 512 may change as they progress from the center of internal cooling cavity towards outlets 322 to increase their density and the resulting surface area that is contacted by the coolant.

Figure 11:
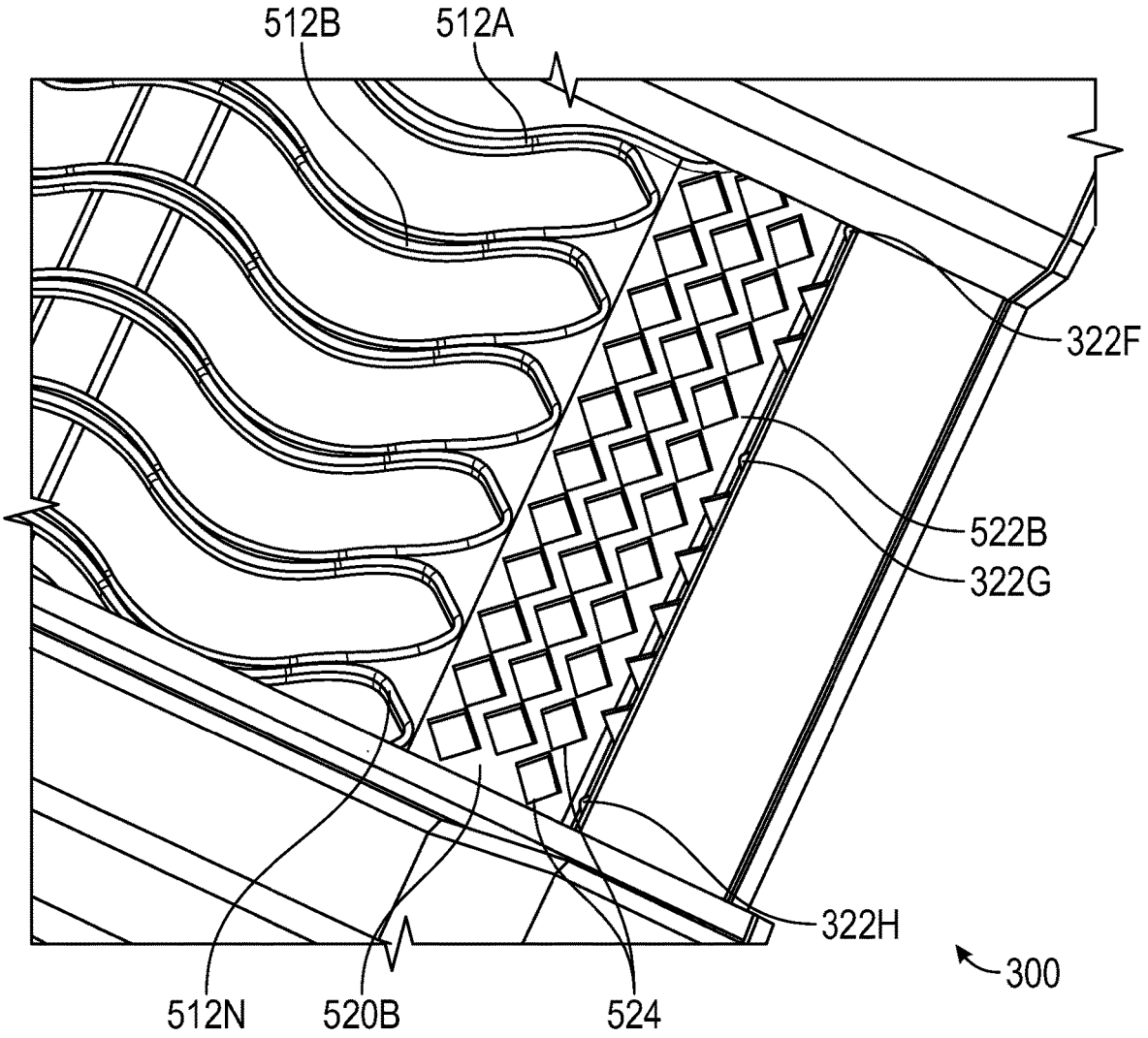
FIG. 11 illustrates a close-up, perspective view of an end portion of a tip shoe, according to an embodiment.

FIG. 11 illustrates a close-up, perspective view of an end portion 520, according to an embodiment. The space of internal cooling cavity 500 is depicted with surrounding physical structures hidden. As illustrated, end portion 520 (e.g., 520B in this case) curves radially inward around a plurality of pins, represented by the negative spaces 524, into a plenum space 522B that connects to outlets 322. The plurality of pins may be formed in rows (e.g., three rows extending laterally between central portion 510 and outlets 322).

Figure 12:
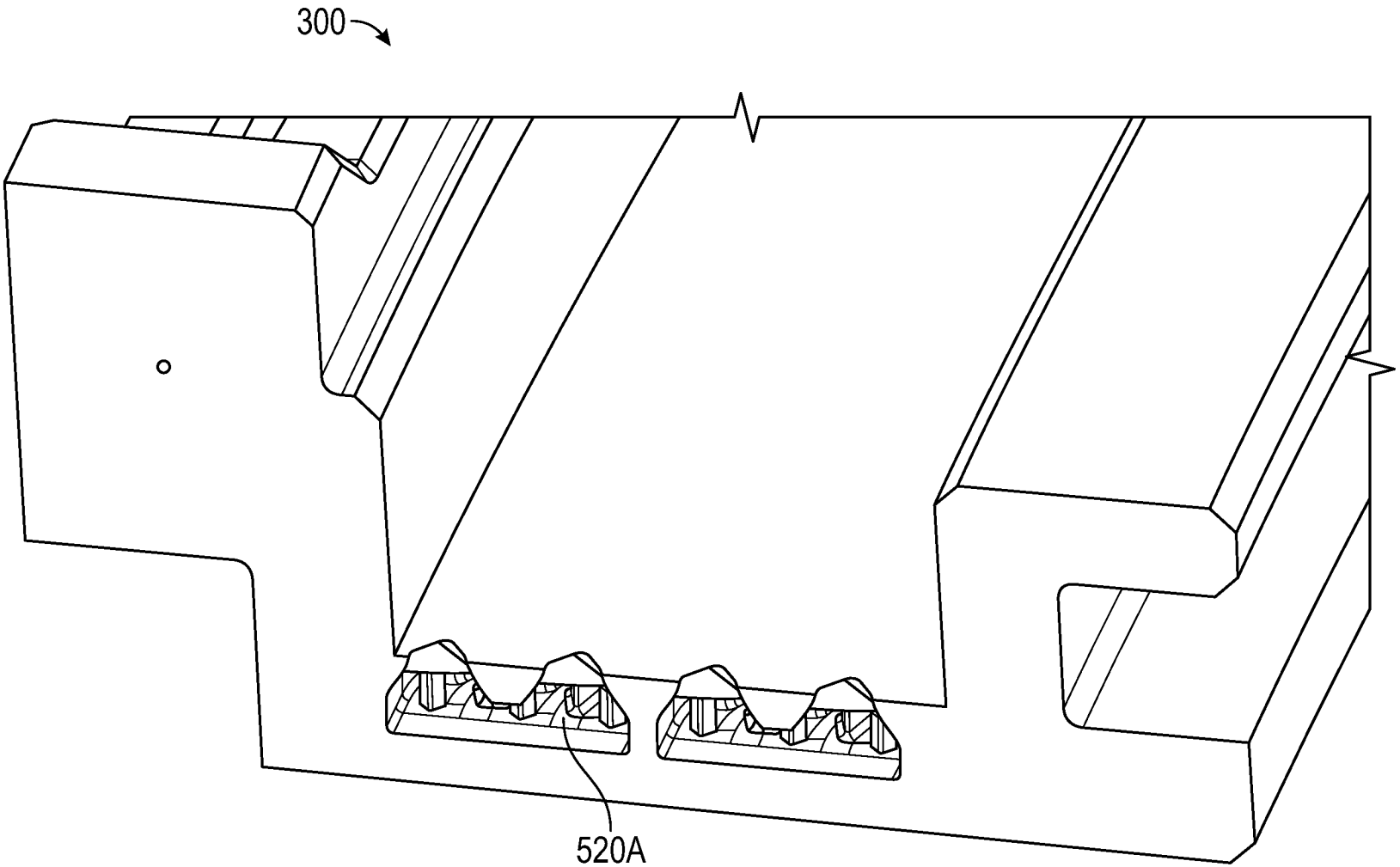
FIG. 12 illustrates a perspective view of a portion of tip shoe, with a cut-away to illustrate internal structures, according to an embodiment.

It should be understood that, in reality, the negative spaces 524 are filled with material representing pins 330. This is illustrated in FIG. 12, which is a perspective view of tip shoe 300, with a cut-away depicting a portion of end portion 520A. As illustrated, end portion 520A is formed around a plurality of pins 330.

Figure 13:
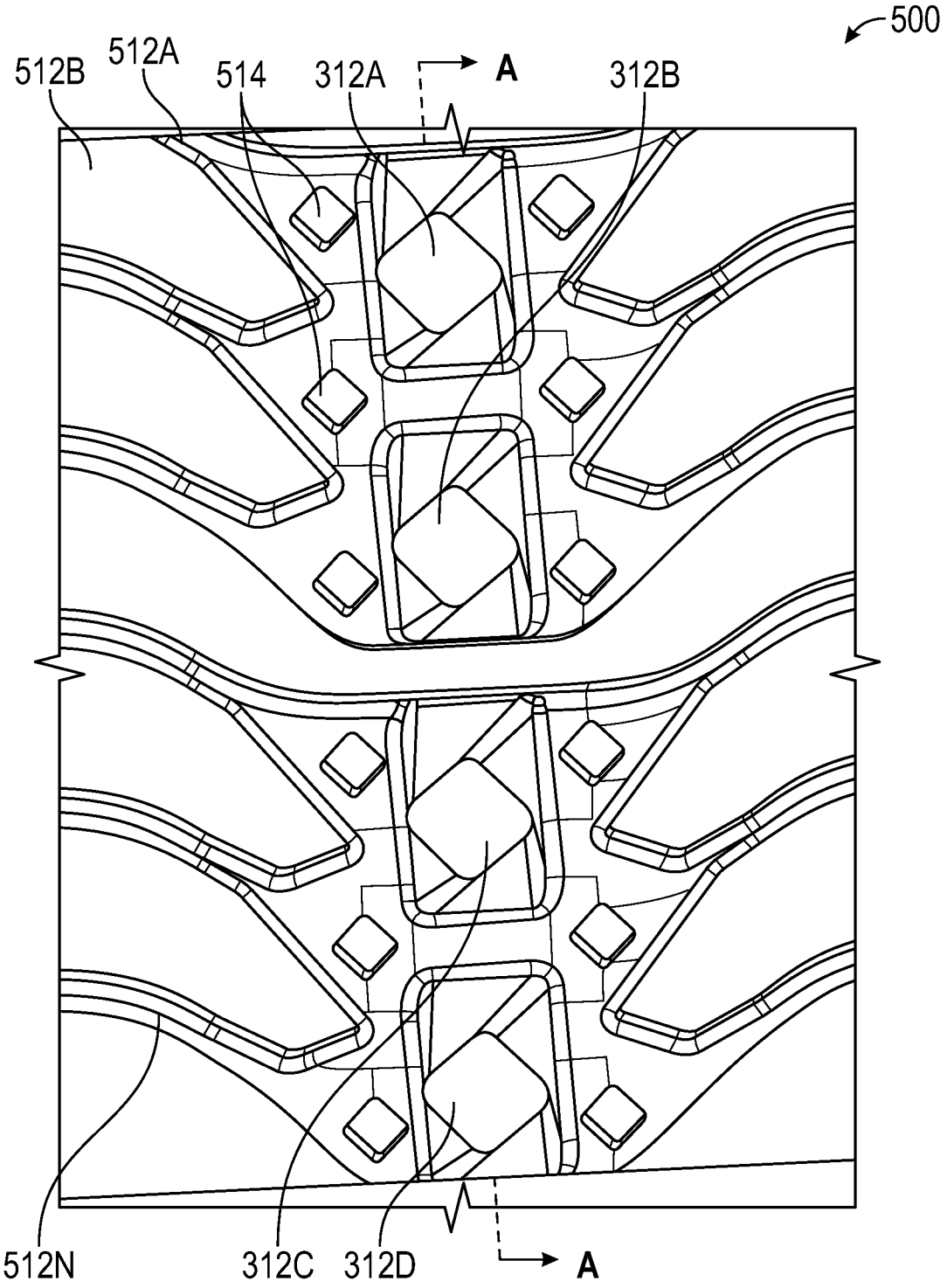
FIG. 13 illustrates a close-up, perspective view of a central portion of internal cooling cavity, according to an embodiment.

FIG. 13 illustrates a close-up, perspective view of the region of central portion 510 of internal cooling cavity 500 that surrounds inlets 312, according to an embodiment. Again, the space of internal cooling cavity is depicted with surrounding physical structures hidden. The region of central portion 510 between inlets 312 and wavy channels 512 may be defined by a plurality of pins (e.g., similar or identical to pins 330). In particular, at least one row of pins, represented by the negative spaces 514, may be formed along an axial axis A on both sides of inlets 312, between inlets 312 and wavy channels 512.

In an embodiment, tip shoe 300 may be manufactured using additive manufacturing (AM). For example, laser powder bed fusion (LPBF) may be used to construct each tip shoe 300. Laser powder bed fusion uses a laser with high power density to fuse metallic powder together. The metallic powder may be Nickel-based alloy powder, Cobalt-based alloy powder, or any other powder that is suitable for the operating conditions within a gas turbine engine 100. Each tip shoe 300 may be constructed as a single piece to have the disclosed structure, using laser powder bed fusion to fuse metallic powder into layers of tip shoe 300, layer by layer.

INDUSTRIAL APPLICABILITY

A plurality of the disclosed tip shoes 300 may be formed into an annular tip shroud 200 to encircle a rotor assembly 142 in a turbine 140 of a gas turbine engine 100. Each tip shoe 300 comprises inlets 312 that supply coolant to an internal cooling cavity 500, which then exits tip shoe 300 via staggered outlets 322 in opposing slash faces of tip shoe 300. Thus, the coolant facilitates cooling of the entire mass of tip shoe 300, including the slash faces, which are prone to high temperatures. The coolant may be cooling air from compressor 120 of gas turbine engine 100.

Internal cooling cavity 500 may be formed around a plurality of pins 330 and/or comprise wavy channels 512. These features, which receive the heat of tip shoe 300 via conduction, increase the surface area that is exposed to the coolant. Thus, the convection rate, at which the coolant extracts heat from the walls and features of tip shoe 300, is greatly increased, thereby improving the cooling of tip shoe 300 by minimizing the maximum temperature and/or minimizing metal thermal gradients. In addition, these features are suitable for construction via additive manufacturing.

It will be understood that the benefits and advantages described above may relate to one embodiment or may relate to several embodiments. Aspects described in connection with one embodiment are intended to be able to be used with the other embodiments. Any explanation in connection with one embodiment applies to similar features of the other embodiments, and elements of multiple embodiments can be combined to form other embodiments. The embodiments are not limited to those that solve any or all of the stated problems or those that have any or all of the stated benefits and advantages.

The preceding detailed description is merely exemplary in nature and is not intended to limit the invention or the application and uses of the invention. The described embodiments are not limited to usage in conjunction with a particular type of machine. Hence, although the present embodiments are, for convenience of explanation, depicted and described as being implemented in a gas turbine engine, it will be appreciated that it can be implemented in various other types of turbomachinery and machines with tip shrouds, and in various other systems and environments. Furthermore, there is no intention to be bound by any theory presented in any preceding section. It is also understood that the illustrations may include exaggerated dimensions and graphical representation to better illustrate the referenced items shown, and are not considered limiting unless expressly stated as such.

What is claimed is:

1. A tip shoe comprising:

a top surface;

an internal cooling cavity;

a plurality of pins extending radially through the internal cooling cavity;

two slash faces on opposing ends of the internal cooling cavity and proximate opposite ends of the top surface;

a plurality of inlets located centrally on the top surface, extending through the top surface and in fluid communication with the internal cooling cavity; and a plurality of outlets through each of the two slash faces and in fluid communication with the internal cooling cavity;

wherein, a fluid flow path is provided to the internal cooling cavity through the plurality of inlets, the fluid flow path encompassing the plurality of pins and both slash faces, and having an exit from the internal cooling cavity via the plurality of outlets through each of the two slash faces.

2. The tip shoe of claim 1, wherein the plurality of inlets comprises two or more inlets aligned along an axial axis that bisects the top surface.

3. The tip shoe of claim 2, wherein the internal cooling cavity is symmetric across the axial axis.

4. The tip shoe of claim 1, wherein the two slash faces comprise a first slash face and a second slash face, and wherein, along an axial axis, positions of the plurality of outlets in the first slash face are staggered relative to positions of the plurality of outlets in the second slash face.

5. The tip shoe of claim 1, wherein the internal cooling cavity comprises a central portion and two end portions, and wherein each of the two end portions curve radially inward into a plenum space that is connected to the plurality of outlets of a respective one of the two slash faces.

6. The tip shoe of claim 1, wherein each of the two slash faces comprises a seal slot.

7. The tip shoe of claim 6, wherein, on each slash face, the plurality of outlets are positioned radially inward from the seal slot.

8. The tip shoe of claim 1, wherein each of two end portions of the internal cooling cavity curve radially inward into a plenum space that is connected to the plurality of outlets of a respective one of the two slash faces.

9. The tip shoe of claim 1, wherein a density of the plurality of pins increases along a flow path from the plurality of inlets towards the plurality of outlets.

10. The tip shoe of claim 1, wherein the internal cooling cavity comprises a plurality of congruent wavy channels that are spaced apart along an axial axis.

11. The tip shoe of claim 10, wherein a density of the plurality of congruent wavy channels increases along a flow path from the plurality of inlets towards the plurality of outlets.

12. The tip shoe of claim 1, wherein the internal cooling cavity comprises a central portion and two end portions, wherein the central portion includes a plurality of congruent wavy channels that are spaced apart along an axial axis, and wherein the tip shoe further comprises a plurality of pins extending radially through each of the two end portions.

13. The tip shoe of claim 12, wherein each of the two end portions curve radially inward into a plenum space that is connected to the plurality of outlets of a respective one of the two slash faces.

14. The tip shoe of claim 12, wherein the plurality of inlets comprises a row of two or more inlets aligned along an axial axis that bisects the top surface, and wherein the tip shoe further comprises, on each of two opposing sides of the row of two or more inlets, at least one row of pins extending radially through the central portion between the row of two or more inlets and the plurality of congruent wavy channels.

15. The tip shoe of claim 1, wherein each of one or more of the plurality of outlets through each of the two slash faces is angled between the internal cooling cavity and that slash face.

16. The tip shoe of claim 15, wherein each of the angled one or more outlets is angled towards an upstream end of that slash face.

17. An annular tip shroud comprising a plurality of tip shoes, wherein each of the plurality of tip shoes includes:

a top surface;

an internal cooling cavity;

a plurality of pins extending radially through the internal cooling cavity;

two slash faces on opposing ends of the internal cooling cavity and proximate opposite ends of the top surface;

a plurality of inlets located centrally on the top surface, extending through the top surface and connected to the internal cooling cavity; and a plurality of outlets through each of the two slash faces and connected to the internal cooling cavity;

wherein, cooling air can be provided to the internal cooling cavity through the plurality of inlets, the cooling air flows around the plurality of pins towards both slash faces and exits internal cooling cavity via the plurality of outlets through each of the two slash faces.

18. The annular tip shroud of claim 17, wherein each of the two slash faces of each of the plurality of tip shoes comprises a seal slot, wherein adjacent ones of the plurality of tip shoes are connected by at least one seal strip inserted into the seal slots of adjacent slash faces, and wherein, on each slash face of each of the plurality of tip shoes, the plurality of outlets are positioned radially inward from the seal slot.

19. A turbine comprising:

one or more rotor assemblies; and a tip shroud encircling each of the one or more rotor assemblies, wherein each tip shroud includes a plurality of tip shoes, and wherein each of the plurality of tip shoes includes a top surface, an internal cooling cavity, two slash faces on opposing ends of the internal cooling cavity and proximate opposite ends of the top surface, a plurality of inlets located centrally on the top surface, extending through the top surface and connected to the internal cooling cavity, and a plurality of outlets through each of the two slash faces and connected to the internal cooling cavity, wherein, wherein, a fluid flow path is provided to the internal cooling cavity through the plurality of inlets, the fluid flow path encompassing the plurality of pins and both slash faces, and having an exit from the internal cooling cavity via the plurality of outlets through each of the two slash faces.

* * * * *